United States Patent [19]

Berry

[11] 3,930,741

[45] Jan. 6, 1976

[54] VIBRATORY COMPACTOR ATTACHMENT

[76] Inventor: James D. Berry, 1579 N. 6th Ave., Springfield, Oreg. 97477

[22] Filed: Oct. 15, 1974

[21] Appl. No.: 514,404

[52] U.S. Cl. ..... 404/133
[51] Int. Cl.[2] ..... E01C 19/34
[58] Field of Search ..... 404/133, 113, 114, 116

[56] References Cited

UNITED STATES PATENTS

| | | | |
|---|---|---|---|
| 2,633,781 | 4/1953 | Day | 404/113 |
| 2,703,222 | 3/1955 | Feucht | 404/133 X |
| 2,771,012 | 11/1956 | Jackson | 404/113 |
| 3,091,159 | 5/1963 | Miller | 404/133 |
| 3,128,682 | 4/1964 | Thompson | 404/113 |
| 3,253,522 | 5/1966 | Piper | 404/113 |
| 3,635,133 | 1/1972 | Stougaard | 404/133 |
| R20,663 | 3/1938 | Cameron | 404/113 |

*Primary Examiner*—Nile C. Byers, Jr.
*Attorney, Agent, or Firm*—James D. Givnan, Jr.

[57] ABSTRACT

A compactor tool for use in conjunction with a mobile prime mover having a vibratory frame to which said tool is mounted. A tool shank is adapted for selective mounting to the vibratory frame and carries a compactor shoe pivotally mounted to the shank lower end, said shoe compacting filled or partially filled conduit burial trenches. Shoes of different widths are readily attachable to said shank for the compacting task at hand. Fluid dispersal means delivers fluid in a metered manner to the shoe when used for compacting paved surfaces.

4 Claims, 7 Drawing Figures

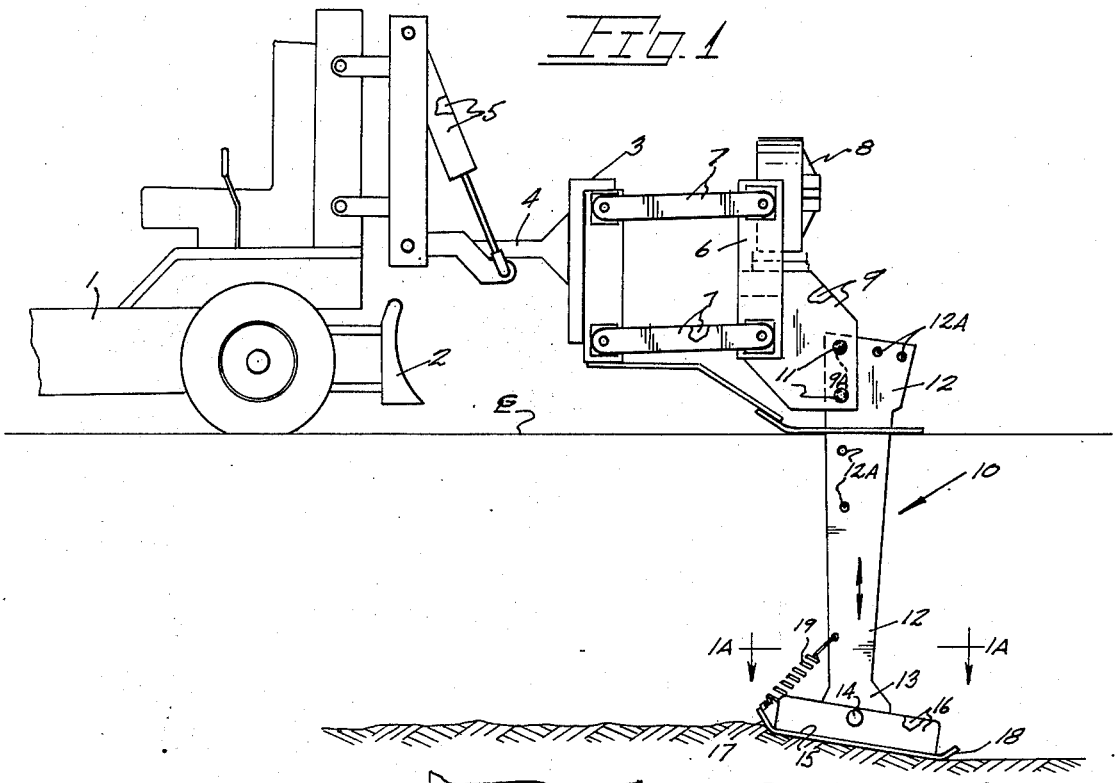
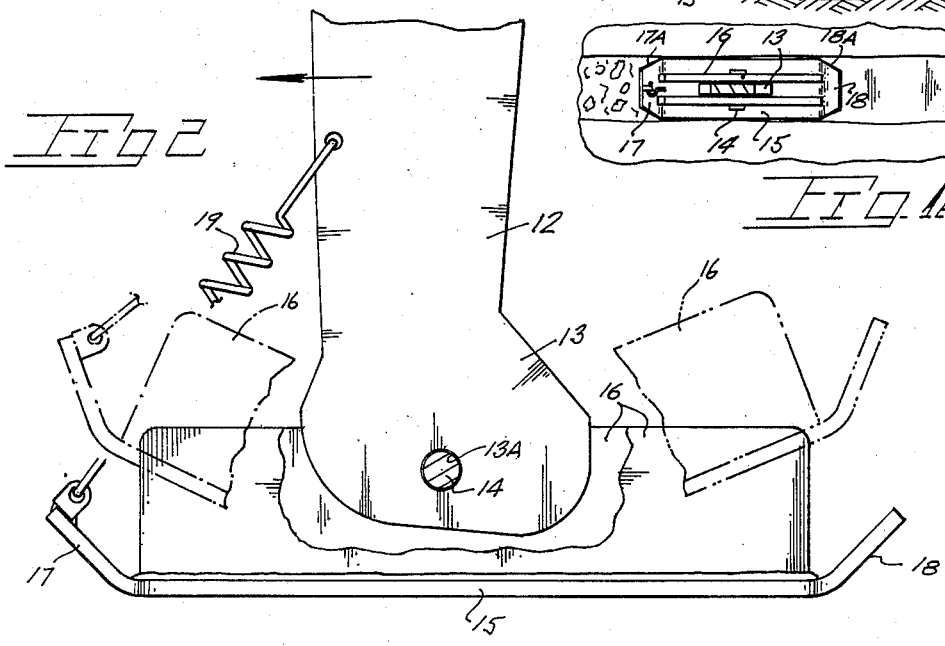
FIG. 1A

VIBRATORY COMPACTOR ATTACHMENT

BACKGROUND OF THE INVENTION

The present invention relates generally to earth compacting equipment and more particularly to a tool for compacting backfilled trenches and related tasks.

Commonly used today for the insertion of buried conduit, both electrical and fluid, are vibratory blades normally having a trailed conduit shoe or guide progressively depositing the conduit within the blade formed kerf. Standard cable laying practice includes the depositing of fines over the deposited conduit which it has been found highly desirable to compact prior to placement of a second conduit thereover. The same is true for conduit laid in a trench formed by a digging operation which trench, of course, is of substantially greater width than the plow formed kerf. A common objective in both modes of conduit placement is the return of the soil to its original, highly compacted state to better protect the buried conduit and to avoid later sinking of the backfilled material. To accomplish compacting presently, manually held vibratory compactors are used to tamp both trench deposited fines and backfill earthen material. Such hand held compacting equipment is slow as compared with mechanized compactors and, of course, requires additional man hours and costly equipment for a conduit laying operation. Such compactors are often air powered requiring the use of a costly air compressor at the job site.

A related problem occurs in the laying of conduit across roadways and driveways where the backfill material is subject to severe loading by reason of passing vehicles. If such material is not adequately compacted before repaving, premature pavement failure can occur, resulting in costly repaving. Accordingly, it is highly desirable to fully compact backfill material for several inches immediately below a paved roadway. Soil compactors associated with road construction are clearly not suitable for trench compaction by reason of size and mode of operation.

SUMMARY OF THE INVENTION

The present invention is directed toward providing a compacting tool for use in conjunction with a wheel supported vehicle with the tool being mounted in an interchangeable manner with a vibratory cable laying blade. In wide use today are a number of different makes of small, highly maneuverable machines, termed trenching machines in the trade, which additionally mount a variety of earth working instrumentalities such as cable laying blades, ditching chains, backfill blades, back hoes, etc.,. The obvious objective of such multipurpose machines is to provide the contractor with a machine capable of performing all tasks encountered in the subterranean burial of electrical or fluid conduit thereby minimizing costly man hour effort. While the several makes of machines intended for this purpose are highly adapted for their intended objective, they make no provision for mechanized compacting.

The present tool includes a shank adapted at its upper end for attachment to a prime mover of the above type having integrally mounted vibratory means. An elongate compaction shoe is pivotally mounted at the lower end of the shank which shoe may "walk" over uneven earthen material to affect progressive compaction. Upturned leading and trailing surfaces of the rockable shoe permit successive passes along the trench in opposite directions allowing the shoe to ride over the uneven surface being compacted while limit stop means, acting intermediate the shank and shoe, prevent excessive shoe oscillations. Provision is made for convenient shoe substitution without lifting the tool shank above the ground surface to permit compaction along paths of different widths as may be encountered in a conduit laying operation.

Important objectives of the present invention include the provision of: a compactor tool highly adaptable for use with a wide variety of different trenching machines to permit mechanized compacting heretofore unavailable with such machines; a compactor tool capable of utilizing existing vibratory means found on trenching machines to accomplish optimum compacting by forward and rearward passes of the tool along a trench in a rapid, inexpensive manner without the use of pneumatic compactors; a compactor tool having a pivotally mounted shoe at its lower end which is readily interchangeable with a shoe of different width to compact paths of various widths as may be encountered in a conduit laying operation.

BRIEF DESCRIPTION OF THE DRAWINGS

In the accompanying drawings:

FIG. 1 is a side elevational view of the present compacting tool in place on a vibratory frame carried by a mobile prime mover, FIG. 1A is a horizontal sectional view taken along line 1A—1A of FIG. 1 showing the shoe compacting a trench bottom, FIG. 2 is an enlarged detail view of the lower end of the tool shank and shoe there attached.

DETAILED DESCRIPTION OF THE PREFERRED EMBODIMENTS

Figure 3:
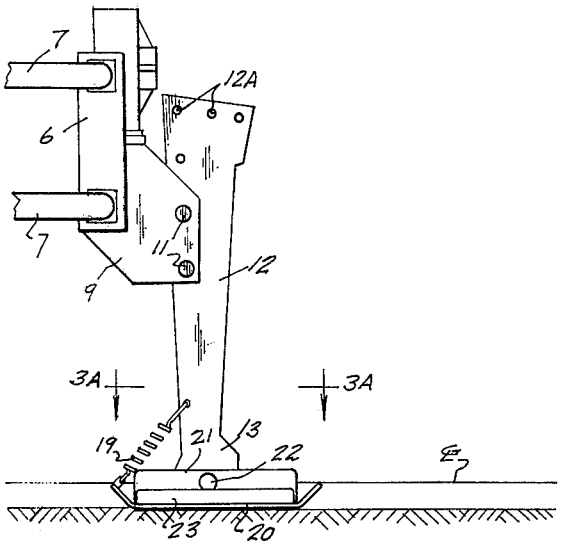
FIG. 3 is a view similar to FIG. 1 with the vibratory frame elevated for surface compaction of a filled trench.
Figure 3A:
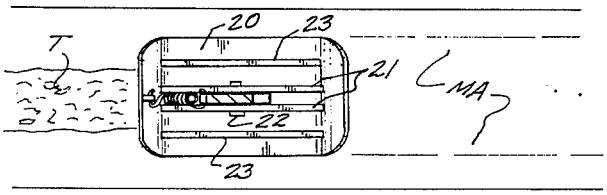
FIG. 3A is a horizontal sectional view taken along line 3A—3A of FIG. 3 showing the shank end and attached shoe.

With continuing reference to the accompanying drawings wherein applied reference numerals indicate parts similarly identified in the following specification, the reference numeral 1 indicates a mobile prime mover of the type used for conduit burial and normally including multiple instrumentalities such as, for example a backfill blade 2, all being usable in trench formation, conduit deposit and backfilling operations. Such prime movers are in wide use by contractors and utility departments for burial of conduit along roadways, drop line service to buildings as well as for burial of fluid carrying conduits. Prime movers of the present type commonly incorporate an auxiliary framework on which is mounted a vibrator for imparting reciprocal motion to a cable laying blade with the auxiliary framework serving to isolate the prime mover and its operator from, to a large extent, the vibratory motion. A typical auxiliary framework is indicated at 3 having a draft connection 4 with the framework being positionable via hydraulic cylinders 5. A vibrator mounting frame 6 is trailed from frame 3 by means of a pair of links 7 constituting a parallelogram linkage between the frames with each of the links terminating in a resilient shock mounting means. A vibrator 8 imparts reciprocal motion along an upright vector to blade mounting plates 9 which are apertured at 9A for the conventional purpose of mounting a cable plowing blade not shown. The above is intended to describe a typical blade support structure to which the present tool may be coupled and in no way is intended to imply any restriction of present tool use.

Indicated generally at 10 is the present compactor tool in attachment with vibratory frame 6 by means of pins 11 passing through mounting plates 9 and apertures 12A formed within the upper portion of a tool shank indicated at 12. Shank 12 is formed of high grade steel approximately five-eighths inch thickness with the apertures 12A located so as to permit selective shank attachment to mounting plates 9. The same shank by reason of such aperture location may be coupled with different vibratory frames associated with other prime movers.

As viewed in FIG. 1, the shank is perpendicularly disposed to the compaction surface and a slight rake on its leading edge terminating downwardly in an enlarged end 13 apertured at 13A to receive a removable pin 14. Pin 14 is preferably of the quick release type used with construction equipment permitting quick detachment for purposes of a wider shoe such as substitution of the later described shoe.

A compactor shoe 15 comprises an imperforate plate reinforced by lengthwise orientated bars 16 spaced from the shoe lengthwise centerline to receive shank portion 13 in a manner permitting shoe movement about the axis of pin 14. The bars 16 are welded along their lower edges to the upper side of shoe 15 to reinforce the shoe against compaction loads. An inclined surface of the shoe is indicated at 17 and is embodied within an upwardly inclined shoe portion while similarly the trailing inclined surface of the shoe is indicated at 18. The leading and trailing edges are relieved at 17A and 18A to avoid penetration of the trench walls. With the tool traveling in the direction of the applied arrow in FIG. 2, leading edge 17 will cause the shoe to assume an inclined attitude as it progressively compacts the material traversed. The extremes of shoe travel about the axis of pin 14 are shown in broken lines. A helical spring 19 interconnects the shoe and shank 12 for pre-positioning the shoe upwardly prior to ground contact. While the terms leading and trailing are applied to the shoe it is to be understood that the shoe is operative in both directions.

As viewed in FIG. 1A, shoe 15 is of a width permitting passage through a trench T approximately 6 inches in width to compact fines deposited therein over a previously laid conduit. Compaction of earthen fines about a buried conduit is desirable with such compaction being performed subsequent to the laying of each conduit in a trench bottom containing multiple conduit runs. Accordingly, the vertical distance separation required between each run of conduit may be lessened as compared with conduit runs deposited in uncompacted trench bottoms thus permitting the trench to be of lesser depth.

With attention to FIG. 3 the vibratory frame 6 has been elevated by powered components of the prime mover with shank 12 being repositioned upwardly relative to mounting plates 9 on said frame. Such upward repositioning of shank 12 and the substition of a wider compactor shoe at 20 enables the tool to be used for compaction of backfill within a trench T simultaneously with compaction of marginal earthen areas MA. During the formation of the trench by a digging instrumentality, earthen material constituting the trench walls is disturbed resulting in its being in a loosely compacted state which if not compacted prior to paving may subsequently sink resulting in early pavement fractures. The width of shoe 20 is adequate to compact the marginal areas for a number of inches to either side of the trench during one pass of the shoe to return the ground to a compact condition very similar to its prior state. If necessary, a second or rearward pass may be made with the shoe which, by reason of the prime mover speed, may be accomplished in a short period. Shoe 20, in addition to reinforcing bars at 21 which also serve to mount pivot means 22, includes a second pair of reinforcing bars 23. The action of shoe 20 during a compacting operation is similar to that above described for the first mentioned shoe 15.

Figure 4:
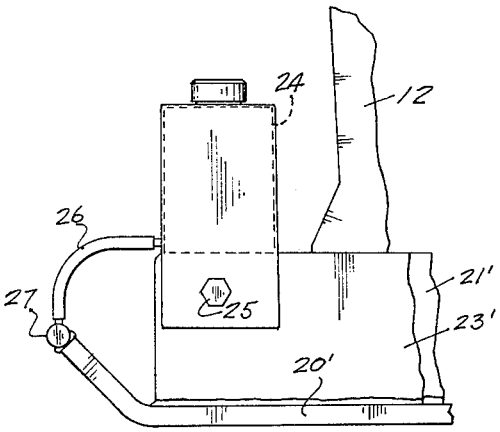
FIG. 4 is a fragmentary side elevational view of a modified form of the invention for dispersing fluid to the underside of the shoe.
Figure 5:
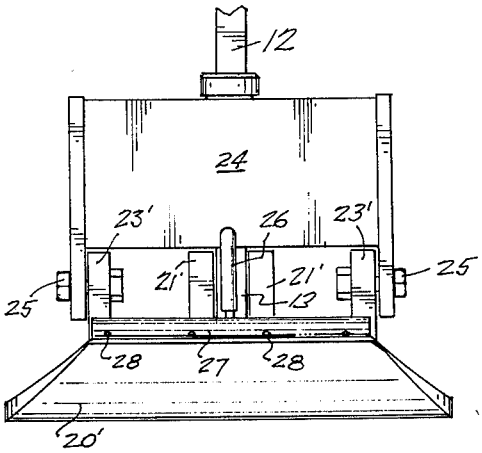
FIG. 5 is a front elevational view of the shoe taken from the left hand side of FIG. 4.

In FIGS. 4 and 5, a shoe 20′ is provided with fluid dispersal means including a reservoir 24 detachably mounted by bolts as at 25 with the reservoir mounted in place across reinforcing bars 21′ and 23′. An outlet conduit 26 delivers a flow of oil to a manifold 27 apertured as at 28 for fluid discharge upon the underside of the shoe. In repaving an asphalt strip to complete a conduit burial operation, shoe 20 may be further utilized to compact asphalt or other road surface material with the deposit of oil on said surface by the fluid dispersal means contributing towards optimum finishing of the material.

While I have shown but a few embodiments of the invention it will be apparent to those skilled in the art that the invention may be embodied still otherwise without departing from the spirit and scope of the invention.

Having thus described the invention what is desired to be secured under a Letters Patent is:

1. A tool for compacting earthen material within and covering a conduit burial trench by successive passes in opposite directions, said tool for attachment to a mobile prime mover having vibratory means thereon, said tool comprising, a shank in perpendicular relationship to the surface being compacted and adapted at its upper end for pinned attachment to shank mounting means on the prime mover, a shoe having upturned leading and trailing surfaces and an imperforate bottom surface, reinforcing bars extending lengthwise of the shoe, pivot means coupling said shoe to the lower end of said shank permitting inclination of the shoe about the axis of said pivot means during a compacting operation so as to permit the forwardly or rearwardly moving shoe to ride over material being compacted, and said shoe contactable with said shank at points spaced from said axis to limit shoe inclination about said axis during tool operation.

2. The tool as claimed in claim 1 wherein said reinforcing bars are in spaced parallel relationship, said shank terminating at its lower end between said bars, said pivot means embodied within a quick release pin extending through said bars and the shank end, said quick release pin permitting shoe substitution for compacting subterranean surfaces of greater width than a conduit burial trench.

3. The tool as claimed in claim 1 additionally including fluid dispersal means affixed to the forward portion of the shoe, said dispersal means including a reservoir, means detachably mounting said reservoir on the shoe reinforcing bars, a conduit disposed transversely along an edge of said shoe in communication with said reservoir for metering fluid to the underside of the shoe.

4. The tool as claimed in claim 1 additionally including means interconnecting one extremity of the shoe to a point on said shank to bias the forward end of the shoe toward an upwardly inclined position.

* * * * *